US005264754A

United States Patent [19]

Hanitijo et al.

[11] Patent Number: 5,264,754

[45] Date of Patent: Nov. 23, 1993

[54] SPARK PLUG

[76] Inventors: Santoso Hanitijo, P.O. Box 1365, Desjardins, Montreal, P.Q., Canada, H5B-1H3; Jacques L. Giguere, 39 Terrasse Robert, Chambly, Quebec, Canada, J3L 1S2

[21] Appl. No.: 825,082

[22] Filed: Jan. 24, 1992

[51] Int. Cl.[5] ..... H01T 13/32; H01T 13/46

[52] U.S. Cl. ..... 313/139; 313/140; 313/142

[58] Field of Search ..... 313/139, 140, 141, 142

[56] References Cited

U.S. PATENT DOCUMENTS

| | | | |
|---|---|---|---|
| 4,268,774 | 5/1981 | Forkum, Jr. | 313/141 |
| 4,288,714 | 9/1981 | Yamada | 313/142 |
| 4,329,615 | 5/1982 | Tanaka et al. | 313/141 |
| 4,336,477 | 6/1982 | Yamada | 313/142 |
| 4,910,428 | 3/1990 | Strumbos | 313/136 |
| 4,916,354 | 4/1990 | Forkum, Jr. | 313/141 |

*Primary Examiner*—Palmer C. Demeo

*Attorney, Agent, or Firm*—Charles P. Boukus, Jr.

[57] ABSTRACT

Disclosed is a spark plug for an internal combustion engine including an annular end portion with a central electrode having an end within the annular end portion. A ground electrode extends from the annular end portion and has a portion extending over and spaced a predetermined distance above the end of the central electrode. The improvement comprises the end of the central electrode having cross-grooves therein defining four end faces and the ground electrode having diverging prongs at its end over the central electrode, a portion of each prong being over two adjacent end faces of the central electrode. Improved ignition is provided without critical manufacturing problems of prior art spark plugs.

4 Claims, 1 Drawing Sheet

SPARK PLUG

FIELD OF THE INVENTION

The invention relates to an internal combustion engine spark plug and more particularly a spark plug having a unique combined configuration of both the ground and center electrodes.

BACKGROUND OF THE INVENTION

Spark plugs are an essential part of internal combustion engines and there are many prior art devices which propose variations in the configuration of either the ground electrode or center electrode.

By way of illustration, the U.S. Pat. No. 4,268,774 to Forkum, Jr., granted May 19, 1981 relates to a spark plug with a ground electrode having split or diverging prongs which continuously diverge into non-parallel angularly spaced apart end portions. The base or vertex region where the two prongs join together is so located relative to the plugs center electrode that a spark bridging the spark gap impinges first at the base region and then splits for simultaneous travel along the end portion. It is critical in the Forkum plug that the location of the base or vertex of the split be carefully located relative to the periphery of the end of the center electrode.

This requires sophisticated manufacturing equipment to split the ground electrode and preferably curve the prongs. This increases the cost of manufacture.

A further refined plug, as taught by Forkum in his U.S. Pat. No. 4,916,354 granted Apr. 10, 1990, has split prongs, with the end of at least one prong re-directed along the periphery of the center electrode. Again, the sophistication in manufacturing and assembling such plugs, in order to properly locate the prongs relative to the center electrode, is apparent.

Others have approached the re-design of spark plugs by concentrating on the configuration of the end of the center electrode. By way of example are the U.S. patents of Tanaka et al, U.S. Pat. No. 4,329,615 granted May 11, 1982; Yamada, U.S. Pat. No. 4,336,477 granted Jun. 22, 1982 and Strumbos, U.S. Pat. No. 4,910,428 granted Mar. 20, 1990.

The spark plug of Tanaka et al teaches a center electrode with a cut portion formed on one side of the center electrode end face opposing the bend in the ground electrode. As part of the prior art (FIGS. 4A, 4B and 5) Tanaka et al discloses that it is known to provide cross-shaped grooves in the end face of the center electrode which has the effect of decreasing the required voltage and also the contact area between the center electrode and the flame core ignited by the discharge. While the cooling effect is reduced, the location of the discharge at certain of the portions of the end face defined by the grooves does not provide the improved ignition performance otherwise desired.

The Yamada plug provides a grooved center electrode along the plane of the grounded electrode to promote the location of discharge gaps on the outer sides of the center electrode adjacent the aligned outer sides of the ground electrode.

The patent to Strumbos simply illustrates plugs with modified center electrodes including single or cross grooves as well as providing a thin coating to resist electrical and residue erosion.

Accordingly there is a need for a spark plug which avoids the criticality of Forkum's type of arrangement and yet provides for good ignition performance.

SUMMARY OF THE INVENTION

Applicant has discovered that by providing a spark plug which includes in combination a split ground electrode and a grooved center electrode, the requirement for close tolerances of the Forkum type plug is not required and yet excellent ignition performance is provided.

Accordingly applicant's invention provides a spark plug which has a ground electrode which is split over the central electrode but the base or vertex of the split need not be within the critical location required by the Forkum device for effective performance. This is achieved in applicant's plug by virtue of combining the split ground electrode with a grooved center electrode. This combination removes the problems of the Forkum type plug but retains enhanced ignition performance in that the sites for discharge are spread out to the prongs both near the base and at the tips of the ground electrode.

More particularly the invention provides a spark plug for an internal combustion engine comprising an annular end portion, a central electrode having an end within the annular end portion and a ground electrode extending from the annular end portion and having a portion extending over and spaced a predetermined distance above the end of the central electrode. The improvement provides a spark plug having the end of the central electrode having cross-grooves therein defining four end faces and the ground electrode having diverging prongs at its end over the central electrode, a portion of each prong being over two adjacent end faces of the central electrode.

DESCRIPTION OF THE PREFERRED EMBODIMENT

Figure 1:
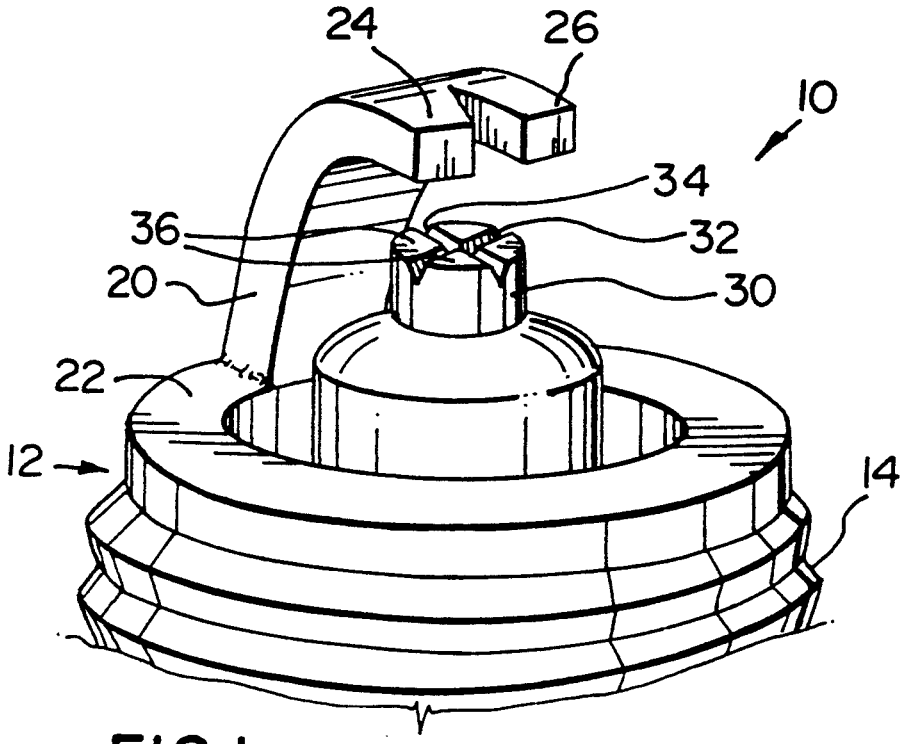
FIG. 1 is a perspective view of the end of an internal combustion engine spark plug showing both the center electrode and the ground electrode.

Turning to the Figures, only the end 10 of spark plug 12 is shown with threads 14 for securing the plug 12 in the appropriate cavity of an engine (not shown).

Ground, electrode 20 extends from annular portion 22 of the end of spark plug 12 and curves or bends over center electrode 30, center electrode having an end face profile with generally "V"-shaped cross grooves 32 and 34 defining central electrode end faces on plateaus 36 (four).

Figure 2:
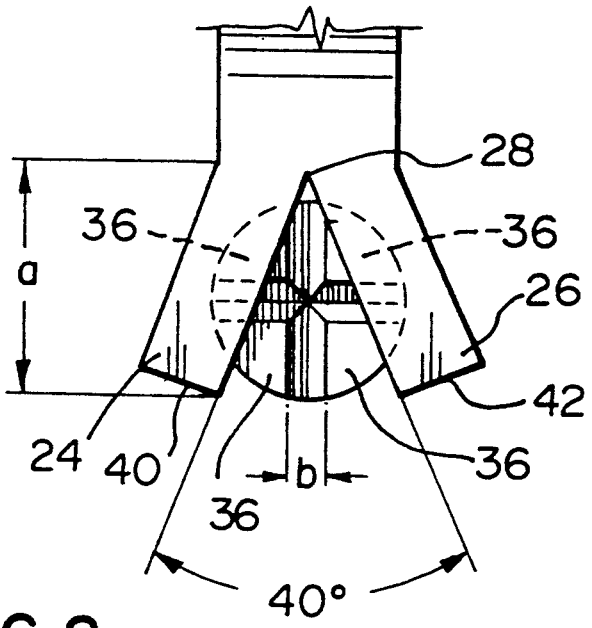
FIG. 2 is a schematic end view of the prongs of the ground electrode and center electrode.

FIG. 2 shows in plan view the spacial relationship of the ground electrode 20 and center electrode 30, the prongs 24 and 26 of electrode 20 diverging from a base or vertex 28 and terminating at ends 40 and 42. The groove 34 extends in the plane of the connection of ground electrode 20 with annular portion 22.

The preferred dimensions, as shown in FIG. 2, has a depth (a) of the split between prongs 24 of about $0.100 \pm 0.010$ inches with the angle of the split preferably about 40°. The width (b) of grooves 32 and 34 are preferably $0.023 \pm 0.002$ inches with the sides of the grooves slanting inwardly preferably at about 60°.

The cross grooves 32 and 34 on the end of the center electrode 30 cause four (4) full sparks from the end faces 36 defined by the grooves and this reduces or prevents intensity variation in the spark otherwise experienced with solid central electrodes and the tendency for the location of sparks to move over the end face thereof.

The split or opening of the ground electrode 20 reduces heat build-up of the two electrodes thus providing longer useful life without electrical erosion. The spread of the sparks between the plateaus of the end face of the center electrode 20 and split ground electrode 30 gives more reliable ignition of an air fuel mixture.

It will be appreciated that the depth of the split between prongs 24 is not critical and may extend beyond the extended periphery of the center electrode 30. The combination of the split ground electrode and grooved center electrode maintains excellent spark performance and removes the criticality of controlling the depth of the split which is a difficult manufacturing task.

Although applicants have disclosed a particularly preferred embodiment of their invention, it will be appreciated by those skilled in the art that variations in the scope of the invention will be apparent to those skilled in the art and to be limited only by the scope of the appended claims.

The embodiments of the invention in which an exclusive property or privilege is claimed are defined as follows:

1. In a spark plug for an internal combustion engine comprising an annular end portion, a central electrode having an annular end of predetermined diameter within the annular end portion of the plug and a ground electrode with a connection extending from said annular end portion in a plane including said connection and said central electrode and having a portion extending over and spaced a predetermined distance above the end of said central electrode, the improvement comprising:

the end of said central electrode having intersecting cross-grooves therein which define four end faces with one of said grooves extending generally in said plane of said connection and the ground electrode having diverging prongs at its end overlying the central electrode, a portion of each prong overlying two adjacent end faces of said central electrode, whereby in use, sparking occurs between each of said end faces and said ground electrode.

2. The spark plug of claim 1 wherein the angle between the prongs is about 40°.

3. The spark plug of claim 1 wherein the grooves are generally "V"-shaped in cross-section.

4. In a spark plug for an internal combustion engine comprising an annular end portion, a central electrode having an annular end of predetermined diameter within the annular end portion of the plug and a ground electrode with a connection extending from said annular end portion in a plane including said connection and said central electrode and having a portion extending over and spaced a predetermined distance above the end of said central electrode, the improvement comprising:

the end of said central electrode having cross-grooves therein which define four end faces, said cross-grooves being generally V-shaped in cross-section with one of said cross-grooves extending generally in said plane of said connection, and the ground electrode having diverging prongs at its end overlying the central electrode, the angle between said prongs being about 40° and a portion of each prong overlying two adjacent end faces of said central electrode, whereby in use, sparking occurs between each of said end faces and said ground electrode.

* * * * *